US008400360B2

(12) United States Patent
Tsai et al.

(10) Patent No.: US 8,400,360 B2
(45) Date of Patent: Mar. 19, 2013

(54) COUPLED-LOOP CHIP ANTENNA

(75) Inventors: Yueh-Lin Tsai, Hsinchu (TW); Meng Hsueh Tsai, Hsinchu (TW); Chin Huang Cheng, Hsinchu (TW)

(73) Assignee: Inpaq Technology Co., Ltd. (TW)

( * ) Notice: Subject to any disclaimer, the term of this patent is extended or adjusted under 35 U.S.C. 154(b) by 744 days.

(21) Appl. No.: 12/355,147

(22) Filed: Jan. 16, 2009

(65) Prior Publication Data

US 2010/0007575 A1 Jan. 14, 2010

(30) Foreign Application Priority Data

Jul. 8, 2008 (TW) ..... 97125755 A

(51) Int. Cl.
*H01Q 1/38* (2006.01)

(52) U.S. Cl. ..... 343/700 MS

(58) Field of Classification Search ..... 343/700 MS, 343/702, 846

See application file for complete search history.

(56) References Cited

U.S. PATENT DOCUMENTS 6,683,573 B2 * 1/2004 Park ..... 343/700 MS
2008/0001822 A1 * 1/2008 Vesterinen ..... 343/700 MS

FOREIGN PATENT DOCUMENTS

JP 10013138 * 1/1998

* cited by examiner

*Primary Examiner* — Robert Karacsony
(74) *Attorney, Agent, or Firm* — Seyfarth Shaw, LLP

(57) ABSTRACT

A loop antenna for communication is provided, which includes a microwave substrate, being a hexahedron; a first conductive layer, disposed on an upper surface of the substrate for forming a first loop; a second conductive layer, disposed on a first side surface of the substrate, and electrically connected to a feed-in point and a ground point; and a third conductive layer, disposed on a lower surface of the substrate for forming a second loop. The first conductive layer and the second conductive layer are electrically connected at the junction between the upper surface and the first side surface, and the second conductive layer and the third conductive layer are electrically connected at the junction between the first side surface and the lower surface. The antenna also has an appropriate bandwidth for wireless communication application.

3 Claims, 4 Drawing Sheets

COUPLED-LOOP CHIP ANTENNA

BACKGROUND OF THE INVENTION

1. Field of the Invention

The present invention generally relates to a miniaturized microstrip antenna, in particular, to a coupled-loop chip antenna.

2. Description of the Prior Art

With rapid development of wireless communications recently, increasingly high requirements on the quality of the wireless communication continuously come up. Antenna is a dispensable communication element for all the wireless applications. In different wireless communication applications, although the requirements on the characteristics of the antenna are different, it can be summarized that, in order to obtain a stable communication quality, the antenna is required to be a communication element having various electrical characteristics such as multiple frequency bands, appropriate bandwidths (depending upon the type of the wireless communication application), a high integrity, a low cost, and a small size. Among the selections of various antenna structures, the loop antenna is one structure adopted by the antennas of various wireless communication products.

The loop antenna is an alternation of a unipole antenna. The conventional unipole antenna is a linear structure, which has a length of at least one fourth of the frequency to be radiated, and is vertical to the vast ground surface. The structure can be easily fabricated but the antenna has the disadvantages including an overly narrow bandwidth, a low integrity, and a large size. The loop antenna makes an improvement on the antenna body of the conventional unipole antenna. For example, Taiwan Patent Publication No. I270236 entitled "Loop Antenna Having Capacitive Structure" has disclosed a loop antenna having a capacitive structure. The loop antenna body is a linear structure with a plurality of three-dimensional bends, and is close and parallel to the vast ground surface for generating coupled capacitance, so as to reduce the size of the antenna and increase the bandwidth. However, the body of the loop antenna having a capacitive structure is a metal line segment with a plurality of three-dimensional bends, and is close to the ground, thus causing a high cost during the fabricating process. Moreover, due to the special three-dimensional bend structure, the antenna in the wireless application product needs to be processed specially to integrate with other structures, and thus has no integrity. In brief, Taiwan Patent Publication No. I270236, entitled "Loop Antenna Having Capacitive Structure," indeed solves the problems in the conventional unipole antenna and the loop antenna, but still fails to provide an antenna having various electrical characteristics including multiple frequency bands, appropriate bandwidth, a high integrity, a low cost, and a small size.

In addition, the chip antenna with a high integrity is a common implementation of antenna, but the characteristics of the antenna applying the chip process technique are always limited to an overly small chip size, for example, the size of the fabricated chip usually is in the range of millimeter (mm). Therefore, the antenna structure in the range of millimeters may generate an unnecessary electric field and magnetic field coupling with the metal wire on other layers or other metal structures, which damages the original antenna performance and causes a narrow operating bandwidth. The bandwidth of the conventional chip antenna is about 30 MHz, which is too narrow for the chip antenna to be applied on various wireless communication devices effectively.

SUMMARY OF THE INVENTION

In order to solve the problems in the prior art, the present invention is directed to a loop antenna, which is designed into a multi-band structure to create appropriate bandwidths, and is a chip antenna fabricated by a low-temperature co-fired ceramics (LTCC) process, thus having a relatively small volume of less than 100 $mm^3$. Therefore, the coupled-loop chip antenna provided in the present invention has many preferable electrical characteristics including a high integrity, a low cost, and an appropriate bandwidth.

In an embodiment of the present invention, a coupled-loop chip antenna is provided, which includes: a microwave substrate, being a hexahedron; a first conductive layer, disposed on an upper surface of the substrate, for forming a first loop; a second conductive layer, disposed on a first side surface of the substrate, and electrically connected to a feed-in point and a ground point; and a third conductive layer, disposed on a lower surface of the substrate, for forming a second loop. The first conductive layer and the second conductive layer are electrically connected at the junction between the upper surface and the first side surface, and the second conductive layer and the third conductive layer are electrically connected at the junction between the side surface and the lower surface. In another embodiment of the present invention, a coupled-loop chip antenna is provided, which includes: a microwave substrate, being a hexahedron; a first conductive layer, disposed on an upper surface of the substrate; a second conductive layer, disposed on a first side surface of the substrate, and electrically connected to the first conductive layer and a feed-in point; a third conductive layer, disposed on a lower surface of the substrate; a fourth conductive layer, disposed on a second side surface of the substrate opposite to the second conductive layer, and electrically connected to the third conductive layer and a ground point; and a fifth conductive layer, disposed on the lower surface of the substrate, and electrically connected to the second conductive layer and the fourth conductive layer. A gap is formed between the fifth conductive layer and the third conductive layer.

BRIEF DESCRIPTION OF THE DRAWINGS

Referring to the figures, wherein the same reference numeral indicates the corresponding parts. Hereinafter the figures are merely schematic views instead of being drawn in the actual ratio scale.

DETAILED DESCRIPTION

Figure 1:
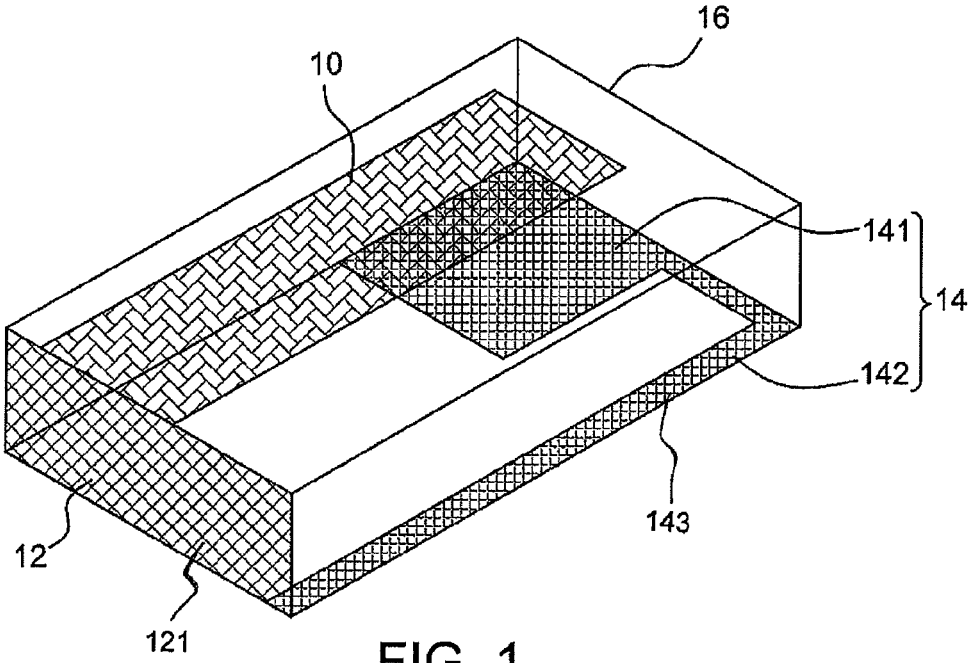
FIG. 1 is a three-dimensional view of a coupled-loop chip antenna according to an embodiment of the present invention, for illustrating the embodiment of the present invention.
Figure 2:
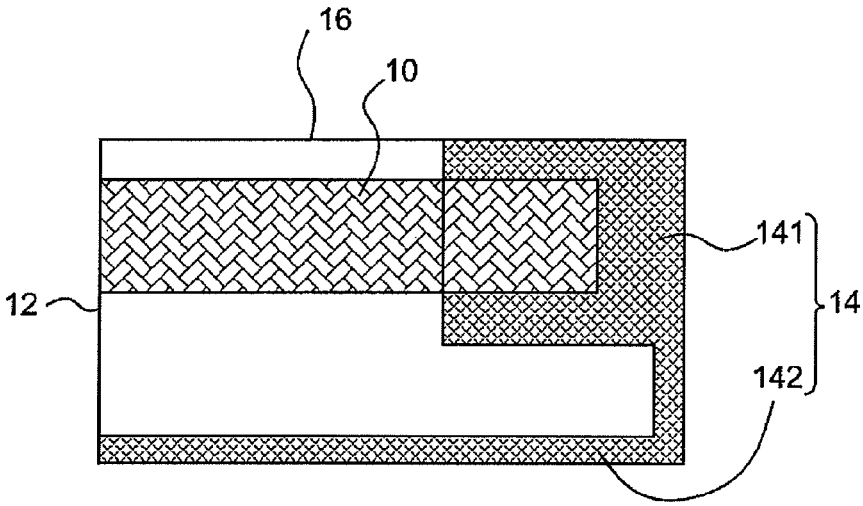
FIG. 2 is a top view of the coupled-loop chip antenna in FIG. 1.

As shown in FIGS. 1 and 2, an coupled-loop chip antenna according to an embodiment of the present invention includes: a microwave substrate (16), being a hexahedron; a first conductive layer (10), disposed on an upper surface of the substrate (16) for forming a first loop; a second conductive layer (12), disposed on a first side surface of the substrate (16), and electrically connected to a feed-in point (121) and a ground point (143); and a third conductive layer (14), disposed on a lower surface of the substrate (16) For forming a second loop. The hexahedron is a cuboid, including a cube. The first conductive layer (10) and the second conductive layer (12) are electrically connected at the junction between the upper surface and the first side surface. The second conductive layer (12) and the third conductive layer (14) are electrically connected at the junction between the first side surface and the lower surface. The third conductive layer (14) includes a bent conductive layer (142) and a rectangular conductive layer (141). In the loop antenna, the bent conductive layer (142) is electrically connected to the second conductive layer (12) directly, and is disposed on the right side of the lower surface. The rectangular conductive layer (141) is electrically connected to the second conductive layer (12) via the bent conductive layer (142). In addition, the rectangular conductive layer (141) is disposed in an area of the lower surface close to a second side surface of the substrate opposite to the first side surface (see FIG. 2).

The first conductive layer is not limited to be the rectangular shape, but may have any other shapes. However, the rectangular shape may maximize the radiation area of the antenna and simplify the process, and the first conductive layer is not limited to be disposed at the left side of the upper surface, but may also cover the whole upper surface so as to maximize its equivalent area.

Furthermore, this embodiment adopts a multi-loop structure design. After a feed-in signal is input through the feed-in point, the current of the signal flows from the second conductive layer (12) to three current paths (loops). In the first loop, the current flows from the second conductive layer (12) to the first conductive layer (10), then is coupled to the third conductive layer (14), and finally back to the second conductive layer (12). The first loop is also in charge of radiating the major operating frequency. A second loop formed by the first conductive layer (10) and the second conductive layer (12) and a third loop formed by the second conductive layer (12) and the third conductive layer (14) also have relatively weak current passing there-through, so as to resonate to generate an additional operating frequency. In the coupled-loop chip antenna provided in this embodiment, the multi-loop effect achieved by the special structure may effectively solve the three technical defects in the prior art. First, the ground surface is applied as a loop, which increases the equivalent radiation area of the whole antenna, and easily reduces the area of the antenna. Second, in the multi-loop structure, when the operating frequencies for resonance are similar to one another, the bandwidth utilized by the loop antenna is much larger than that of the single loop, so as to alleviate the defect of narrow bandwidth caused by the miniaturization of the chip antenna. Third, it can be seen from FIG. 1, the rectangular conductive layer (141) in the third conductive layer (14) partially overlaps the first conductive layer (10), and the overlapping part may have a capacitive effect due to the current coupling. By means of the capacitive effect, the impedance at the input end is adjusted to match the impedance at the feed-in port, so that the return loss is reduced to achieve a high efficiency. In addition, the first conductive layer (10) and the bent conductive wire (142) are respectively disposed at two sides of the substrate (16), and thus the structure may prevent the overly large capacitive effect from affecting the impedance matching of the signal input.

Figure 3:
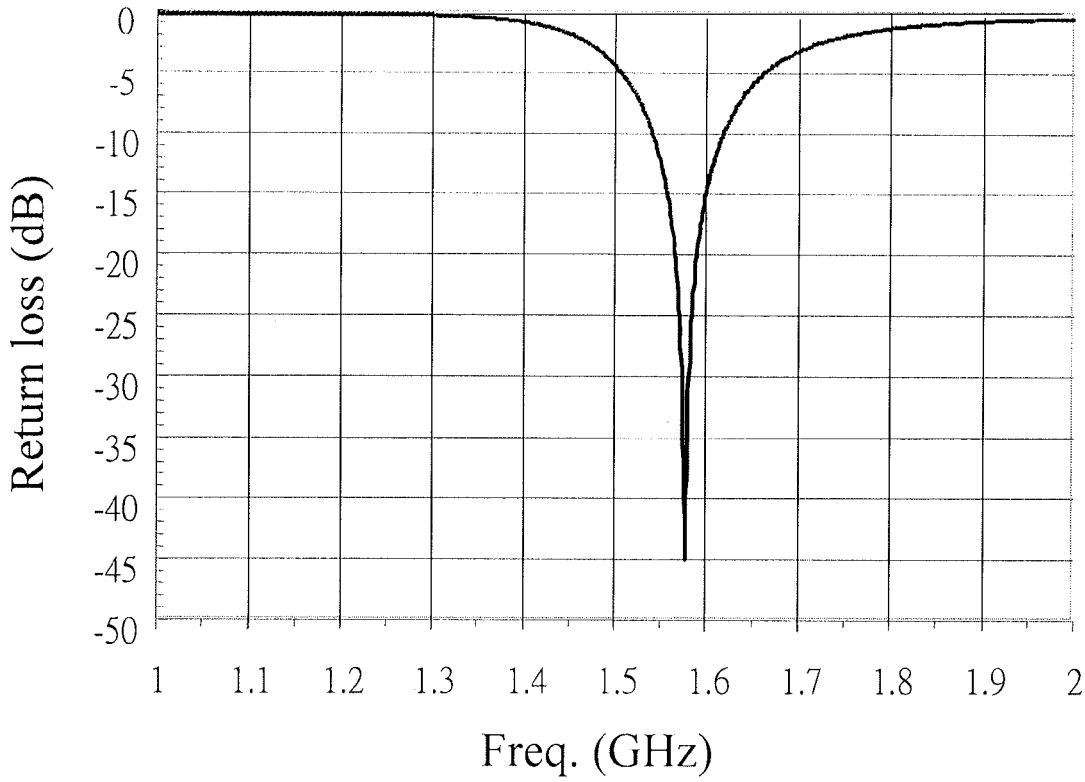
FIG. 3 is a return loss diagram of the coupled-loop chip in FIGS. 1 and 2.

FIG. 3 is a return loss diagram of the coupled-loop chip in FIGS. 1 and 2. FIG. 3 shows the operating frequency of the coupled-loop chip antenna from about 1.81 GHz to 2.12 GHz. The bandwidth is about 310 MHz, which is 10.3 times as much as that of the prior art.

Referring to FIGS. 1 and 2, in the coupled-loop chip antenna, all the antenna parts are in simple geometrical shapes, such as rectangle. The simple geometrical pattern is a simple layout in a low-temperature co-fired ceramics (LTCC) process.

Figure 4:
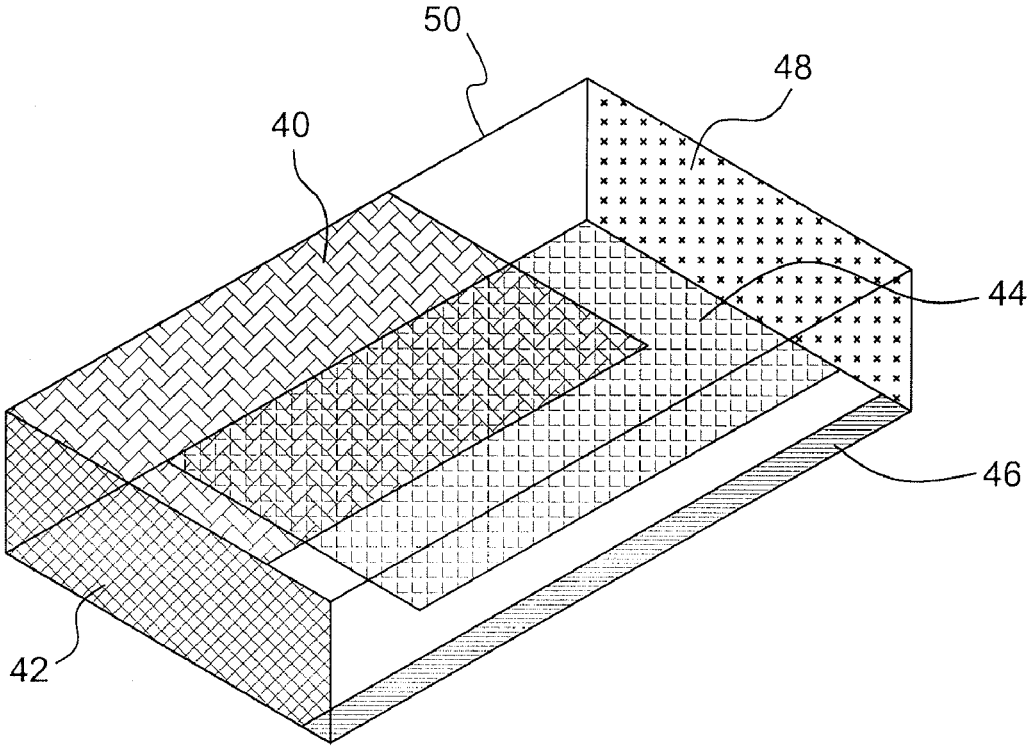
FIG. 4 is a three-dimensional view of a coupled-loop chip antenna according to another embodiment of the present invention, for illustrating the embodiment of the present invention.
Figure 5:
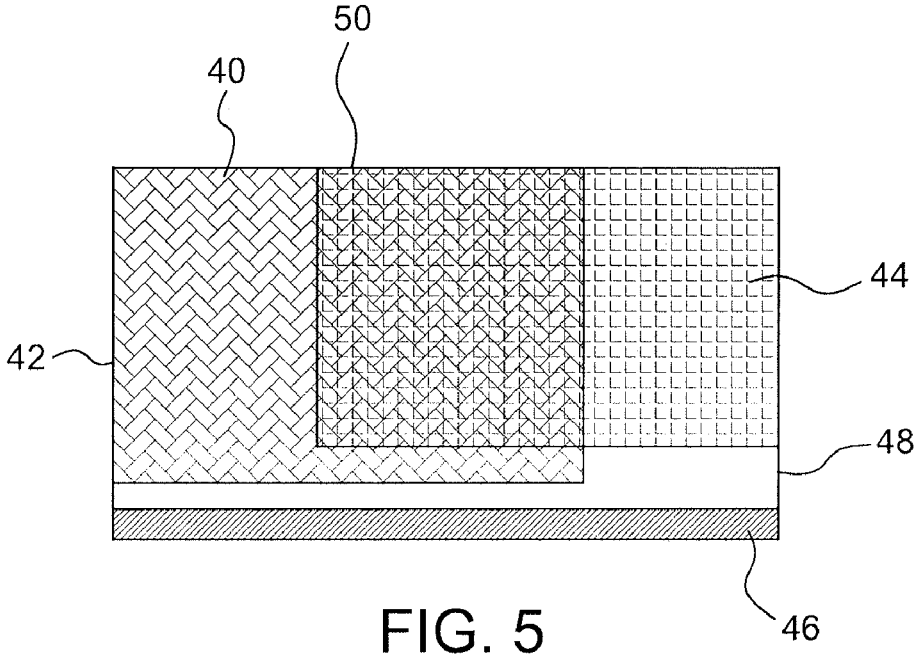
FIG. 5 is a top view of the coupled-loop chip antenna in FIG. 4.

As shown in FIGS. 4 and 5, a coupled-loop chip antenna in another embodiment of the present invention includes: a microwave substrate (50), being a hexahedron; a first conductive layer (40), disposed on an upper surface of the substrate (50); a second conductive layer (42), disposed on a first side surface of the substrate (50), and electrically connected to the first conductive layer (40) and a feed-in point (not shown in FIGS. 4 and 5); a third conductive layer (44), disposed on a lower surface of the substrate (50); a fourth conductive layer (48), disposed on a second side surface of the substrate (50) opposite to the second conductive layer (42), and electrically connected to the third conductive layer (44) and a ground point (not shown in FIGS. 4 and 5); and a fifth conductive layer (46), disposed on a lower surface of the substrate (50), and electrically connected to the second conductive layer (42) and the fourth conductive layer (44). A gap is formed between the fifth conductive layer (46) and the third conductive layer (44).

Furthermore, this embodiment also employs a loop structure design. When a feed-in signal is input from the feed-in point, the current of the signal flows from the second conductive layer (42) to the first conductive layer (40), then is coupled to the third conductive layer (44), and finally back to the second conductive layer (42) after passing through the fourth conductive layer (48) and the fifth conductive layer (46).

In the coupled-loop chip antenna in this embodiment, the loop effect achieved by the special structure may also effectively solve the technical defects in the prior art. In the coupled-loop chip antenna provided in this embodiment, since the ground surface is applied as a part of the loop, the equivalent radiation area of the whole antenna is increased, the area of the antenna itself is easily reduced, and the efficiency of the antenna is thus increased. The efficiency of the coupled-loop chip antenna provided in this embodiment is 88%. In addition, it can be seen from FIG. 5 that, the first conductive layer (40) partially overlaps the third conductive layer (44) in the vertical direction, so as to produce a capacitive effect. By means of the capacitive effect, the impedance at the input end is adjusted to match the impedance at the feed-in port, so that the return loss is reduced to achieve a desired bandwidth. In addition, a gap is formed between the fifth conductive layer (46) and the third conductive layer (44). The gap may prevent the overly large capacitive effect from affecting the impedance matching of the signal input, and maintain the loop architecture of the coupled-loop chip antenna provided in this embodiment.

Figure 6:
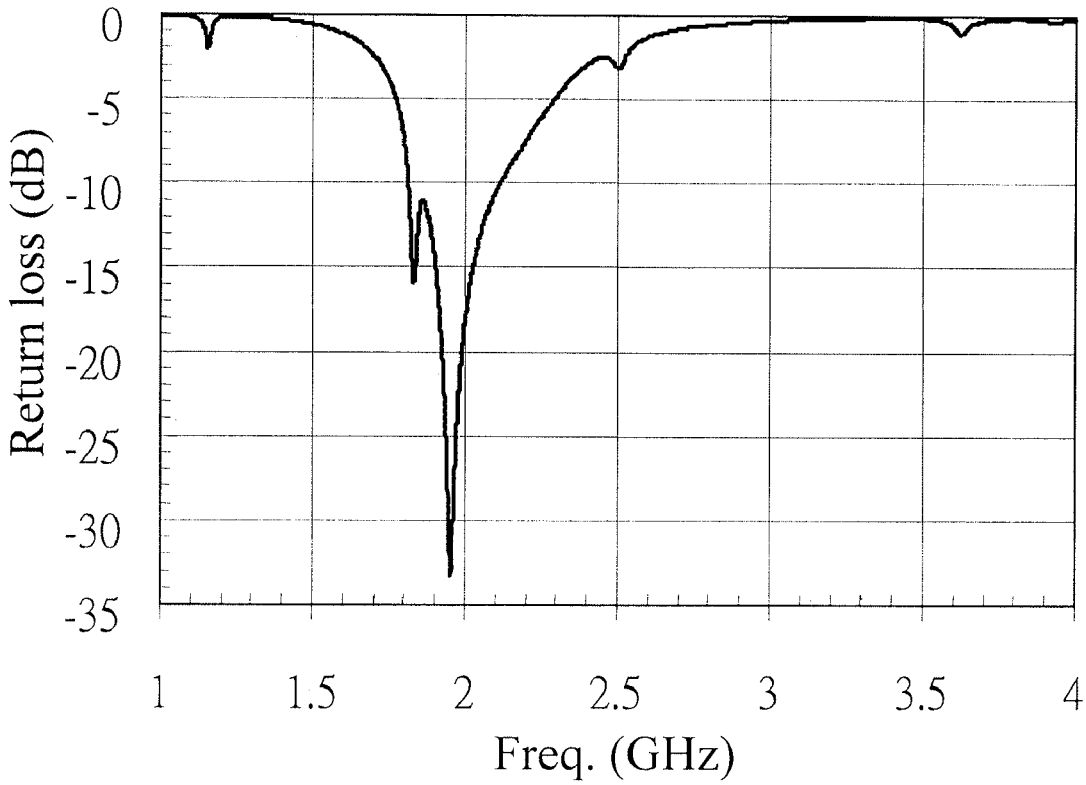
FIG. 6 is a return loss diagram of the coupled-loop chip in FIGS. 4 and 5.

FIG. 6 is a return loss diagram of the coupled-loop chip in FIGS. 4 and 5. FIG. 6 shows the operating frequency of the coupled-loop chip antenna from about 1.54 GHz to 1.68 GHz. The bandwidth is about 80 MHz, which is 2.7 times as much as that in the prior art.

Referring to FIGS. 4 and 5, in the coupled-loop chip antenna, all the antenna parts are in simple geometrical shapes, such as rectangle. The simple geometrical pattern is a simple layout in the LTCC process.

Based on the above, the coupled-loop chip antenna disclosed in the present invention employs simple geometrical shapes to help accomplishing the LTCC process, and also obtains the advantages including high integrity, low cost, and small volume. The present invention utilizes the coupled-loop structure to manufacture appropriate bandwidth on a desired wireless communication application, so as to make up the defect of insufficient bandwidth of the miniaturized microstrip antenna.

The above embodiments are merely provided for illustrating the principle and functions of the present invention, instead of limiting the present invention. It can be known with reference to the accompanying drawings of the present invention, since alternations on the structure of the present invention may be made without departing from the scope of the present invention, other embodiments can also be implemented.

LIST OF REFERENCE NUMERALS

10 First Conductive Layer
12 Second Conductive Layer
14 Third Conductive Layer
16 Microwave Substrate
40 First Conductive Layer
42 Second Conductive Layer
44 Third Conductive Layer
46 Fifth Conductive Layer
48 Fourth Conductive Layer
50 Microwave Substrate
141 Rectangular Conductive Layer
142 Bent Conductive Layer

What is claimed is:

1. A coupled-loop chip antenna comprising:

a microwave substrate shaped as a hexahedron;

a first conductive layer, disposed on an upper surface of the substrate, adapted to form a first loop;

a second conductive layer, disposed on a first side surface of the substrate, and electrically coupled to a feed-in point and a ground point; and a third conductive layer, disposed on a lower surface of the substrate, adapted to form a second loop, wherein the first conductive layer and the second conductive layer are electrically coupled at a first junction between the upper surface and the first side surface, and the second conductive layer and the third conductive layer are electrically coupled at a second junction between the first side surface and the lower surface; and wherein the third conductive layer includes a bent conductive layer and a rectangular conductive layer, and wherein the first conductive layer partially overlaps the rectangular conductive layer and does not overlap the bent conductive layer in a vertical direction perpendicular to the upper surface of the substrate.

2. The antenna according to claim 1, wherein the first conductive layer is rectangular and has a length and a width less than a length and a width of the upper surface, and wherein the first conductive layer is disposed at a left side of the upper surface.

3. The antenna according to claim 1, wherein the bent conductive layer is electrically coupled to the second conductive layer at the second junction between the first side surface and the lower surface and is disposed at a right side of the lower surface, and wherein the rectangular conductive layer is electrically coupled to the second conductive layer via the bent conductive layer, and the rectangular conductive layer is disposed in an area of the lower surface close to a second side surface of the substrate opposite the first side surface.

* * * * *